United States Patent [19]

Shamie et al.

[11] Patent Number: 4,837,875

[45] Date of Patent: Jun. 13, 1989

[54] FOLDING PLAYPEN WITH ATTACHED FABRIC ENCLOSURE

[76] Inventors: Sam Shamie; Louis Shamie, both of 175 Liberty Ave., Brooklyn, N.Y. 11212

[21] Appl. No.: 206,474

[22] Filed: Jun. 13, 1988

[51] Int. Cl.[4] ..... A47D 7/00

[52] U.S. Cl. ..... 5/99 C; 5/99 R

[58] Field of Search ..... 5/93 R, 93 B, 99 R, 5/99 A, 99 B, 99 C, 98 R, 98 A

[56] References Cited

U.S. PATENT DOCUMENTS

| | | | |
|---|---|---|---|
| 2,254,939 | 9/1941 | Elias | 5/99 R |
| 2,486,054 | 10/1949 | Morse | 5/99 A |
| 2,617,999 | 11/1952 | Mitchell | 5/99 A |
| 3,018,493 | 1/1962 | Wittbrodt | 5/98 R |
| 3,163,870 | 1/1965 | Scotney, III | 5/98 R |
| 4,008,499 | 2/1977 | Wren, Jr. et al. | 5/99 C |
| 4,070,716 | 1/1978 | Satt et al. | 5/99 C |
| 4,538,309 | 9/1985 | Gunter | 5/99 C X |
| 4,688,280 | 8/1987 | Kohus et al. | 5/99 R |
| 4,703,525 | 11/1987 | Shamie | 5/99 R |

*Primary Examiner*—Gary L. Smith
*Assistant Examiner*—Michael J. Milano
*Attorney, Agent, or Firm*—Notaro & Michalos

[57] ABSTRACT

A playpen or crib includes a frame with a fabric enclosure connected thereto. Floor supports of the frame have inner ends which are connected to each other by a hub that permits swinging of the floor supports in a horizontal plane from a use position to a folded position. Uprights are connected by hinges to the outer ends of the floor supports. Bendable side and end rails interconnect the tops of the uprights. The fabric enclosure has sleeves for accommodating the uprights and the cross-members to define a space. A stiffened mattress is provided in the space and is supported by the floor supports in their use position. One of the cross-members can be removed or is provided with a mechanism to permit its elongation. In this way, the frame can be folded with all other parts permanently connected to each other and without removing the fabric enclosure.

11 Claims, 5 Drawing Sheets

FIG. 10
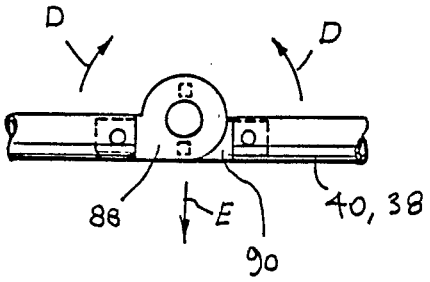
FIG. 11
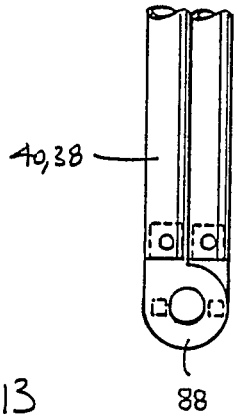
FIG. 12
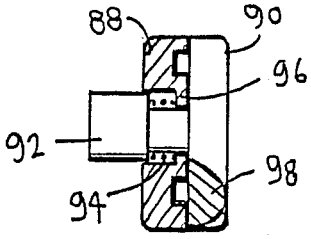
FIG. 13
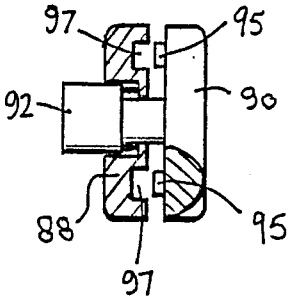
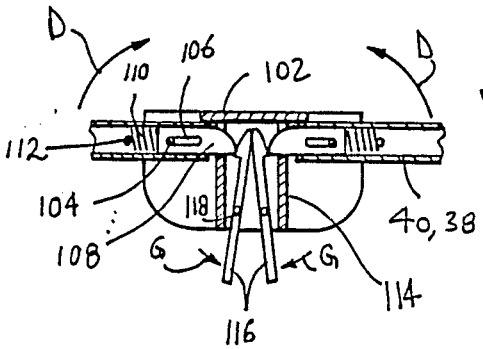
FIG. 14
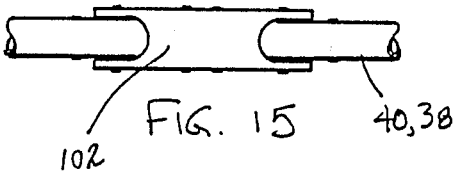
FIG. 15
FIG. 16
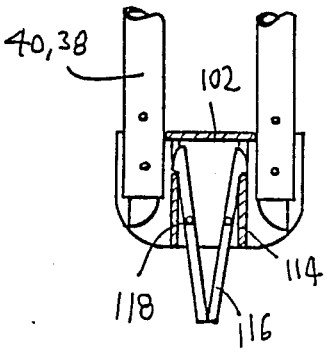

FOLDING PLAYPEN WITH ATTACHED FABRIC ENCLOSURE

FIELD AND BACKGROUND OF THE INVENTION

The present invention relates in general to playpens and non-full size cribs, and in particular to a new and useful folding playpen which has a fabric enclosure that is attached to a frame and wherein the frame plus enclosure can be folded as one piece, into a very small volume.

U.S. Pat. No. 4,703,525 to Shamie discloses a foldable playpen having four floor support members which extend outwardly from a central hub. Upright members are connected to the outer ends of the floor support members. End cross-members interconnect the upper ends of the upright members. A removable fabric enclosure can be slipped down over the end cross-members and upright members to form a playpen or crib enclosure. Side cross-members are then installed between the upright members. This patent, which is incorporated here by reference, teaches that the floor support members can be folded in a horizontal plane about their central connecting hub and that the upright members can be hinged in such a way that they fold down into a lowered position substantially parallel to the floor support members for storage. Initially, however, the fabric enclosure and the cross-members must be removed from the floor support members.

It would be advantageous to minimize the number of separate parts which must be assembled in order to form the playpen.

U.S. Pat. No. 4,688,280 to Kohus et al. discloses a foldable playpen which also utilizes a foldable frame having floor support members and upright members onto which a fabric enclosure can be engaged. No upper cross-members are disclosed in this reference however.

U.S. Pat. No. 4,538,309 to Gunter discloses a foldable playpen having a frame and a fabric enclosure which is tensioned on the frame.

U.S. Pat. No. 4,008,499 to Wren, Jr. et al. discloses a foldable playpen a having a central hub from which four floor support members extend. Foldable upright members form the remainder of the frame which can accommodate a fabric enclosure and a separately insertable stiffened mattress.

SUMMARY OF THE INVENTION

The present invention is drawn to a foldable playpen or crib construction which can be folded into a very small package while, at the same time, being made of a relatively few number of disassemblable parts. In one embodiment of the invention, only a stiffened mattress need be removed from the fabric enclosure before the entire enclosure plus frame is folded as one piece.

In another embodiment of the invention, only one cross-member extending from one end of the playpen to the other, need be removed before the frame plus enclosure can be folded. In the fiest embodiment, a cross-member is provided with means for elongating and bending the cross-member. Elongation is needed to accommodate folding of the floor supports in a horizontal plane about a central hub which interconnects the inner ends of the floor supports. As the floor supports swing around to one side of the playpen, the cross-member must also bend. Joints must be provided between all the cross-members and the uprights to which they are connected, for permitting bending and pivoting of the cross-members. In this way, during an intermediate stage of the folding operation, all of the cross-members and all of the upright members extend substantially parallel to each other. Lower corner hinges which are provided between the uprights and the floor support members may then be activated to fold the uprights to a position substantially parallel to the floor support members.

The entire folding operation can be conducted with the fabric enclosure connected to the frame.

To unfold the playpen, the process is reversed. The last step of the process is the insertion of a stiffened mattress onto the floor of the fabric enclosure. The stiffened mattress is supported on the deployed floor support members which form an X-shaped platform below the fabric enclosure.

The various features of novelty which characterize the invention are pointed out with particularity in the claims annexed to and forming a part of this disclosure. For a better understanding of the invention, its operating advantages and specific objects attanined by its uses, reference is made to the accompanying drawings and descriptive matter in which preferred embodiments of the invention are illustrated.

BRIEF DESCRIPTION OF THE DRAWINGS

In the drawings:

FIG. 10 is a fragmentary side elevational view showing one embodiment of bending means for bending remaining cross-members of the playpen.

FIG. 11 is a view similar to FIG. 10 showing a bent position for the cross-member;

FIG. 12 is a sectional view, partly in elevation, of the bending means of FIG. 10, showning in a locked position;

FIG. 13 is view similar to FIG. 12 showing the bending means in an unlocked position;

FIG. 14 is a sectional view showing another embodiment of the bending means;

FIG. 15 is a top plan view of the bending means of FIG. 14; and

FIG. 16 is a view similar to FIG. 14, showing the bending means in a bent position.

DESCRIPTION OF THE PREFERRED EMBODIMENTS

Figure 1:
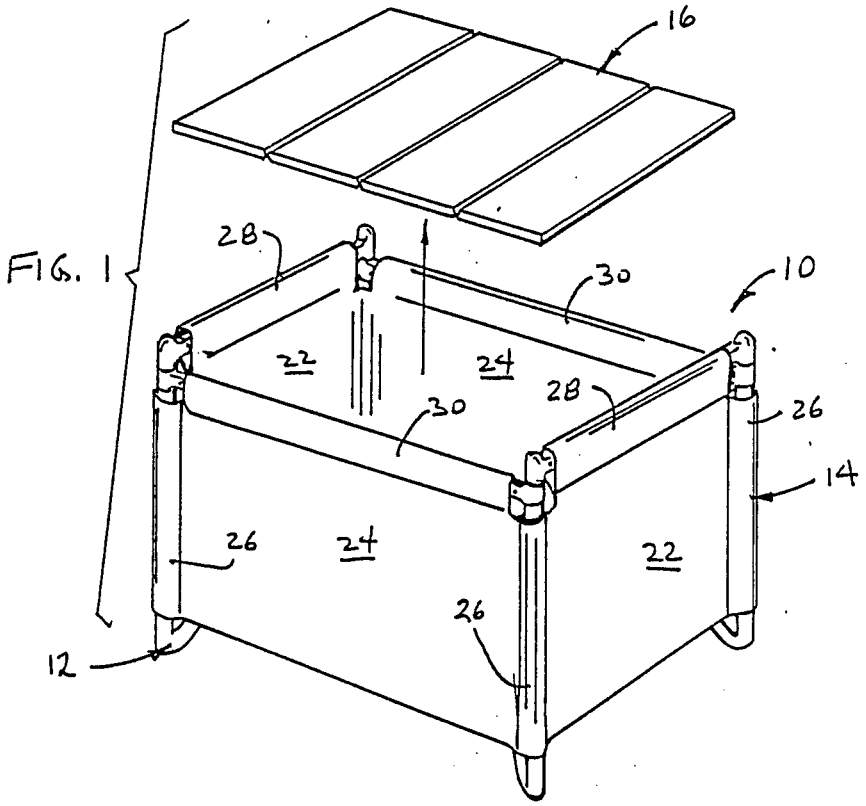
FIG. 1 is a perspective view of the inventive playpen in its unfolded use position, and with its stiffened mattress being removed.

Referring to the drawings in particular the invention embodied in FIG. 1 comprises a foldable playpen or crib 10 having a frame 12, shown in a use position, and which can be folded into a storage position. A fabric enclosure 14 is connected to the frame 12, and preferably although not necessarily permanently fixed to the frame.

A stiffened mattress 16 which is advantageously made in multiple sections which can fold with respect to each other, can be inserted into the floor of the enclosure 14 to complete the playpen.

Figure 2:
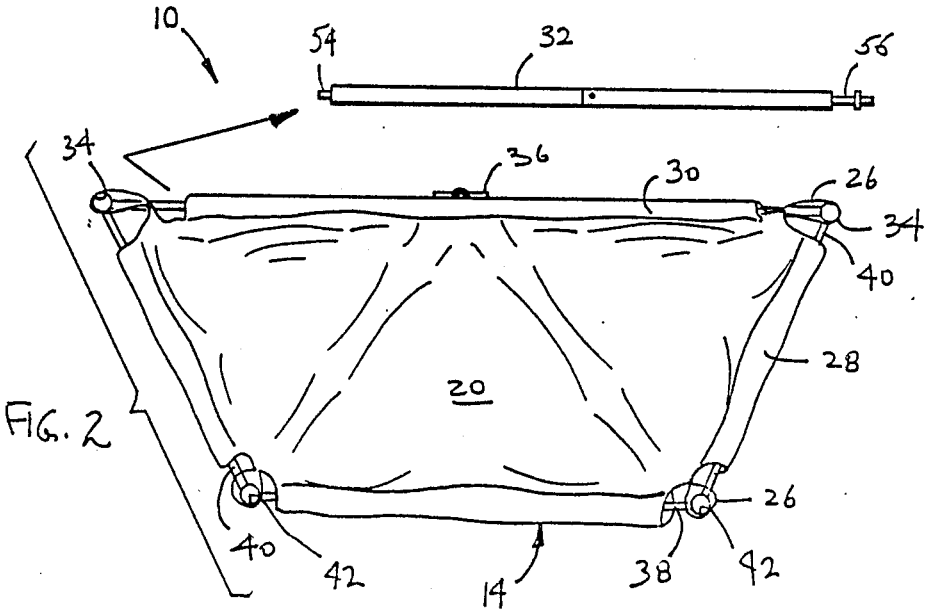
FIG. 2 is a top plan view of the embodiment of FIG. 1, showing the playpen as it is being folded, and with one of its cross-members having been removed.
Figure 3:
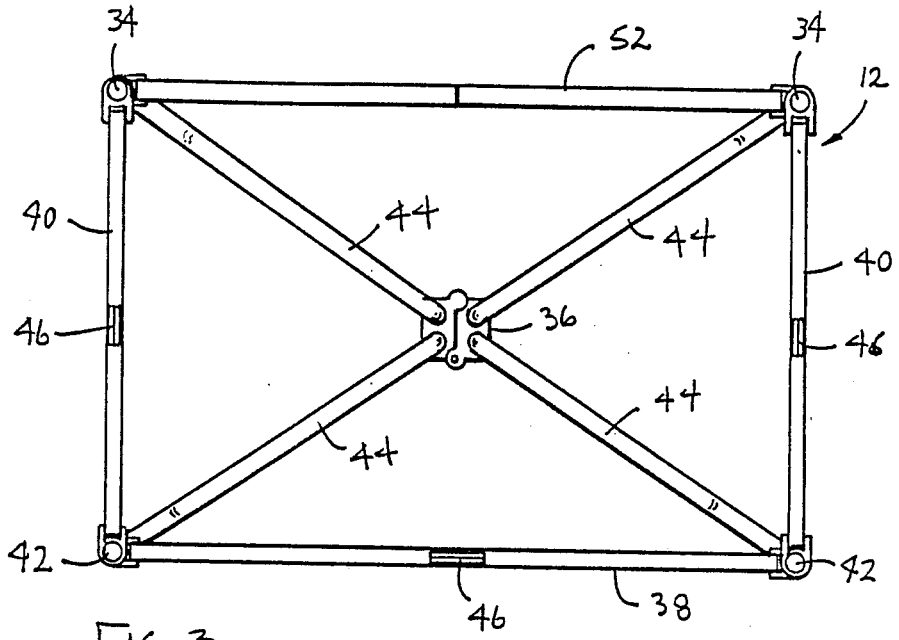
FIG. 3 is a top plan view of a second embodiment for the frame of the playpen, with the fabric enclosure removed.

Enclosure 14 comprises a floor panel 20 shown in FIG. 2, having an outer periphery formed with or sewn to a pair of end panels 22 and a pair of side panels (FIG. 1). The side and end panels are connected to each other at upright sleeves 26 which receive uprights 34 and 42 of the frame 12. End sleeves 28 at the ends of the playpen receive end cross-members 40 of the frame while side sleeves 30 receive side cross-members 38 and 32 of the frame.

Advantageously, sleeves 26, 28 and 30 are permanently sewn to the panels 22 and 24 so as to permanently engage the frame 12. Alternatively, means may be provided to permit removable of the fabric enclosue 14 for washing. Such means may include the use of cross-members that can be disengaged from frame 12 so that they can be removed from sleeves 28 and 30 and so that sleeves 26 can be slid up off the uprights of the frame.

To fold the embodiment of FIGS. 1 and 2, one of the side cross-members 32 is first disengaged from its uprights 34 and slid out of its end sleeve 30. Cross-member 32 which is removed from between uprights 34, is provided with a fixed pin 54 at one end for engaging a hole in one of the uprights 34, and a spring loaded pin 56 for engaging a hole in the other upright 34. Additional details concerning this arrangement can be found in U.S. Pat. No. 4,703,525. Removal of cross-member 32 permits uprights 34 to spread apart to allow the floor supports (not visable in FIG. 2) to swing in a horizontal plane around a central hub 36 to which inner ends of the floor supports are connected. To accommodate this swinging movement, the outer ends of the floor supports are forced together on one side of the hub 36. To accommodate this movement together of the floor supports, the remaining side cross-member 38 connected between uprights 42 must include bending means in the form of a hinge or other structure to permit bending of the cross-members preferably near their center.

In folding the frame plus enclosure, the space between uprights 34 must momentarily increase. This requires either the removal of the first side cross-member 32 or provision of a first side member which is capable of being elongated and bent. This second possibility is illustrated in connection with the embodiment of FIGS. 3 through 6.

In addition to removing or elongating the first side cross-member, the fabric of the inclosure 14 between the uprights 34 must accommodate elongation. This is possible either by making sleeves 26 large enough to permit swinging of the sleeves into a position between the uprights 34 (as shown in FIG. 2), or by connecting sleeves 26 to the remainder of the enclosure by flat web pieces (not shown) so that the web can swing into a position between uprights 34. In addition, the natural resiliency of the fabric can also be utilized to accommodate a momentary stretching of the enclosure between the uprights 34.

Turning now to the embodiment of FIGS. 3 through 6 where the same reference numerals are utilized to designate the same or similar parts, frame 12 comprises four floor supports 44 which have inner ends that are interconnected to each other by a central hub 36 which permits relative pivoting of the floor supports 44 in a horizontal plane about the central hub 36. Additional details concerning the construction and alternate embodiments for central hub 36 can be found in U.S. Pat. No. 4,703,525, identified and incorporated by reference above.

Uprights 34 and 42 are connected to respective outer ends of the floor supports 44. End cross-members 40 are connected between upper ends of uprights 34 and 42 on both ends of the playpen. A first side cross-member 52 having elongation and bending means incorporated therein, is connected between the uprights 34 while a second side cross-member 38 is connected between the uprights 42. Cross-members 38 and 40 each include bending means 46 which permits the bending and downward folding of the cross-members.

Figure 4:
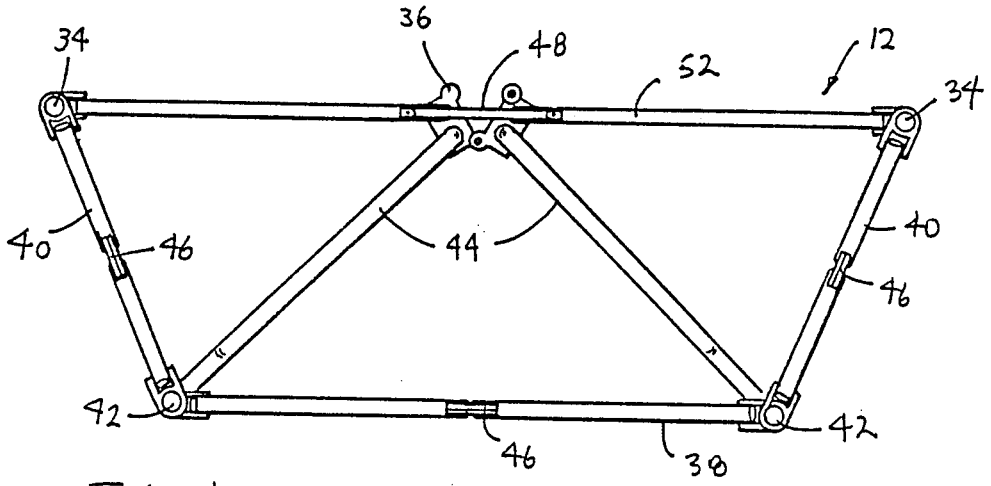
FIG. 4 is a view similar to FIG. 3, showing an intermediate position during the folding of the playpen frame.

As shown in FIG. 4, during an initial folding position which is equilvalent to the position shown in FIG. 2, side cross-member 52 must become elongated if it is to remain connected to uprights 34. This is done by providing elongation means 48 in cross-member 52.

Figure 5:
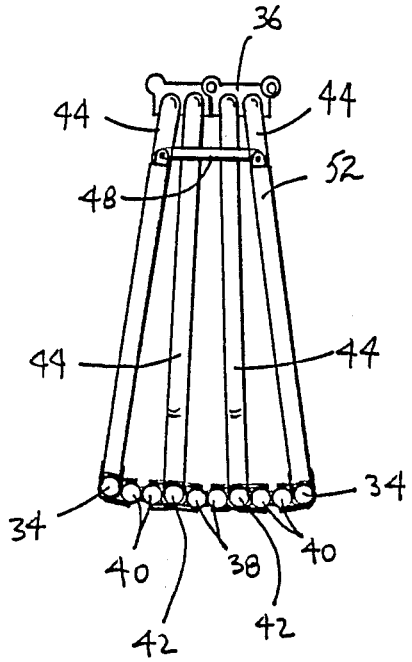
FIG. 5 is a view similar to FIG. 4, showing an further intermediate position during the folding of the playpen.

Turning now to FIG. 5, swinging of the floor supports 44 continues until all floor supports are on one side of the central hub 36. At some point during the swinging of floor supports 44, hub 36 opens to allow the inner ends of floor supports 44 to extend along a substantially straight line as shown in FIG. 5.

The opposite outer ends of floor supports 44, along with the uprights 34 and 42, and the now bent cross-members 38 and 40, also extend in a substantially straight line. This also involves the bending of the side cross-member 52 by virtue of its elongation and bending means 48.

Figure 6:
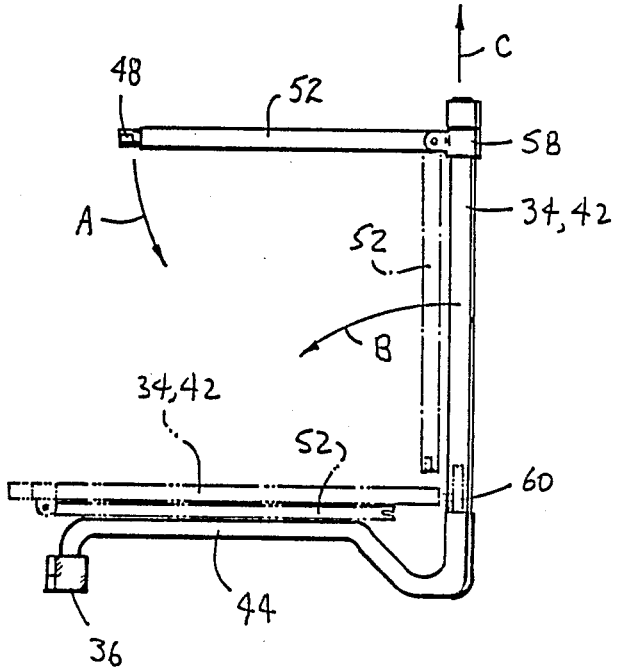
FIG. 6 is a side elevational view of the playpen of FIG. 5, showing how the frame is ultimately folded into its storage position.

As shown in FIG. 6, the now bent cross-member 52 can be pivoted about a suitable provided upper corner hinge 58 in the direction of arrow A until bent cross-member 52 is brought to its single dot phantom line position, parallel to the uprights 34, 42.

Lower corner hinges 60 are also provided between the uprights 34, 42 and their respective floor supports 44, to permit downward pivoting of the uprights in the direction of arrow B until all uprights and cross-member lie substantially parallel to the floor supports 44, in the double dot phantom line position shown in FIG. 6.

Lower corner hinge 60 may be embodied by any hinge capable of locking in an upright position and being foldable downwardly as shown in FIG. 6. One example is the corner hinge disclosed in U.S. Pat. No. 4,703,525. If this type of hinge is used, the uprights 34, 42 must first be raised in the direction of arrow C before they can be pivoted down in the direction of arrow B. Another example of a hinge that can be used as lower corner hinge 60 is shown in U.S. Pat. No. 4,688,280.

Although the fabric enclosure is not shown in FIGS. 3 through 6, the fabric enclosure can easily fold along with the frame without requiring a removal of the enclosure.

Figure 7:
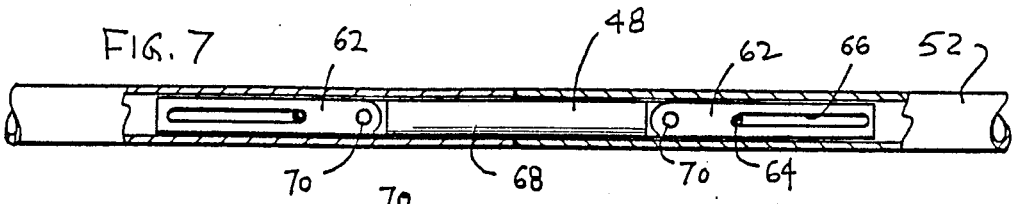
FIG. 7 is a fragmentary sectional view of a cross-member using the embodiment of FIG. 3, illustrating the means for elongating and bending the cross-member.
Figure 8:
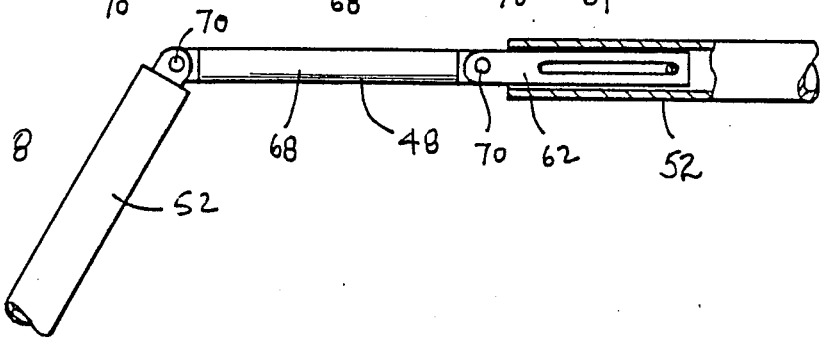
FIG. 8 is a view similar to FIG. 7 showing the cross-member in its elongated and partly bent condition.

FIGS. 7 and 8 shown one embodiment for elongation means 48. In this embodiment, cross-member 52 is made of two parts of tubing having substantially equal lengths. A slide plug 62 made of metal, nylon or other strong plastic, is slid into the end of each section. A rivet or pin 64 extending through and fixed to both parts of the cross-member 52 accommodates a slot 66 in the plug 62 to permit sliding of plug 62 out of the end of the cross-member parts as shown in FIG. 8. An identical plug 62 is provided in both parts of cross-member 52. A central connector 68 is pivotally connected at hinges 70 between plugs 62 to permit bending of cross-member 52 in a horizontal plane. Central connector 68 can be made of the same material as plug 62. Advantageously, connector 68 has approximately the same length as the span of the outer floor supports 44 as shown in FIG. 5. This makes it easier to pivot the cross-member 52 downwardly in the direction of arrow A as shown in FIG. 6.

Instead of the structure shown in FIGS. 7 and 8, any other elongation and bending means may be provided in cross-member 52. It is only necessary that the cross-member be elongated and bent to accommodate the movement of the floor supports around the central hub 36.

Figure 9:
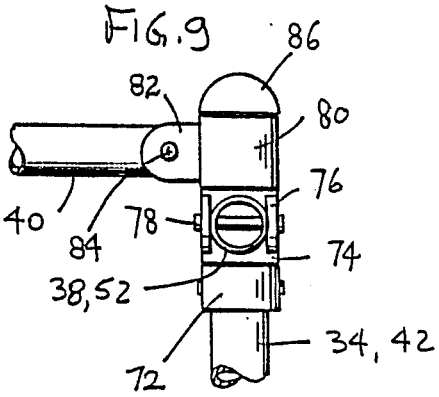
FIG. 9 is a side elevational view showing upper corner hinge means for connecting cross-members to uprights of the frame.

FIG. 9 showns an embodiment for the upper corner hinges that connect the cross-member 38, 40 and 52 to the uprights 34 and 42.

A lower sleeve shaped stop 72 is pinned or riveted to the upright 34 or 42 at a location spaced from the top of the upright. A first hinge sleeve 74 is then engaged around the upright and above the stop 72 for free rotation about the upright. Sleeve 74 has a pair of ears 76 engaged on opposite side of the end of side cross-member 38 or 52. A pivot pin 78 pivotally connects the end of the cross-member to the ears 76.

A second hinge sleeve 80 is engaged around the upper end of the upright and is rotatable above sleeve 74. Sleeve 80 includes a pair of ears 82 engaged on opposite sides of the end cross-member 40. A pivot pin 84 pivotally connects cross-member 40 to ears 82. A cap 86 closes the top of the uprights for safety and cosmetic reasons.

FIG. 10 through 13 show one embodiment of bending means for the cross-members 40 or 38. A first disk 88 has a tangentially extending stub that extends into the end of one section of the cross-member and is likewise pinned or riveted thereto. A second disk 90 is pinned or riveted to the end of the other section of the cross-member. Teeth of one disk engage into recesses of the other disk when the sections of the cross-members are in line with each other as shown in FIG. 10. The teeth and recesses can be positioned to also lock the disks with the sections parallel to each other as shown in FIG. 11, or to leave the disks unlocked in that position (not shown).

When the disks are unlocked, the sections can be pivoted in the direction of arrows D in FIG. 10. This is accommodated by downward movement of the disk in the direction of arrow E.

As shown in FIGS. 12 and 13 disk 90 has a button 92 which extends through a central hole of disk 88. Button 92 has an enlarged head which forms one seat of a spring 94. The other seat of spring 94 is provided by a flange 96 in the hole through disk 88.

A tangentially extending stub 98 is provided for each disk 88 and 90 for insertion into one section of the cross-member. Teeth 95 extending from the inner surface of disk 90 engage into recesses 97 of the other disk 88 for locking the disks in the position of FIG. 10. By pressing button 92, spring 94 is compressed (FIG. 13) and teeth 95 disengage from recesses 97 permitting the two sections of the cross-member to pivot downwardly with respect to each other.

Disks 88 and 90 may be made of metal, nylon or other rugged material.

FIGS. 14 through 16 shown another embodiment for the bending means. This embodiment comprises a block 102 having spaced apart pins or rivets 104 therethrough which extend through the ends of the sections of cross-members 40 or 38. Pins 104 also extend into the slot 106 of a plunger 108 having a rounded end for each section of the cross-member. Springs 110 bias plungers 108 toward each other and are held in the ends of the cross-member sections by pins or rivets 112. The ends of plungers 108 extend into slot provided at the top of a partition wall 114 in block 102. A pair of levers 116 are also pivotally connected at 118 to block 102. The upper ends of levers 116 have protrusions which engage the ends of plungers 108. By squeezing the lower ends of the levers 116 together in the direction of arrows G, plungers 108 are pushed out of the openings in the partitions 114 to permit pivoting of the cross-member sections upwardly in the direction of arrows D. This brings the structure in the position shown in FIG. 16.

Block 102 has an upper flange as shown in FIG. 15 with semicircluar cutouts that permits movement of the cross-member section into the positions shown in FIG. 16.

The button 92 of the bending means of FIG. 10, and the levers 116 of the bending means of FIG. 14, can be activated by feel, through the sleeves of the fabric-enclosure. Alternatively, slots or openings can be provided in the sleeves near the bending means.

While specific embodiments of the invention have been shown and described in detail to illustrate the application of the principles of the invention, it will be understood that the invention may be embodied otherwise without departing from such principles.

WHAT IS CLAIMED IS:

1. A foldable playpen, comprising:

a frame;

a fabric enclosure connected to said frame and defining a space;

a stiffened mattress in said space for defining a ridged floor in said enclosures;

said frame comprising a plurality of floor supports for supporting said mattress, hub means interconnecting said floor supports at inner ends thereof for movement in a horizontal plane between a use position and a folded position, an upright for each floor support, lower corner hinge means connected between the lower end of each upright and an outer end of one of said floor supports for locking each upright in a use position extending upwardly from said floor support and in a folded position extending substantially parallel to said floor support, a plurality of cross-members connected between adjacent pairs of said uprights, and bending means in at least some of said cross-members for permitting bending of said at least some of said cross-members to accommodate movement together of said uprights as said floor supports are moved toward their folded position.

2. A playpen according to claim 1 wherein one of said cross-member is removably connected to an adjacent pair of uprights for removal of said one cross-member before movement of said floor supports toward their folded position.

3. A playpen according to claim 1 wherein all of said cross-member include bending means, one of said cross-members also including elongation means for permitting momentary elongation and subsequent bending of said one cross-member as said floor supports are moved toward their folded position.

4. A playpen according to claim 3 wherein said bending means and said cross-members other then said one cross-member, provide for bending in a vertical plane when said uprights to which said cross-members are connected move toward each other as a result of said floor supports moving toward their folding position.

5. A playpen according to claim 4 wherein said bending means of said one cross-member permits bending of said one cross-member in a horizontal plane.

6. A playpen according to claim 1 wherein said fabric enclosure is permanently connected to said frame, said mattress being removable from said space and said fabric enclosure being foldable with said frame.

7. A foldable playpen comprising a frame;

a fabric enclosure connected to said frame and defining a space;

said frame comprising:

four floor supports extending in an X-shaped configuration when in a use position, said floor supports having inner adjacent ends and outer deployed ends;

a central hub connected to said inner ends of said floor supports for permitting pivoting of said floor supports about said hub and in a horizontal plane form said use position to a folded position with said inner ends of said floor supports extending in a substantially straight line and said outer ends of said floor supports extending in a substantially straight line;

an upright for each of said floor supports;

lower corner hinge means connected between said outer end of each floor support and one of said uprights for locking said uprights in an upright use position and for permitting pivoting of said uprights downwardly into a folded position substantially parallel to said floor supports;

a pair of end cross-members pivotally connected between adjacent pairs of uprights at opposite ends of the playpen;

a first side cross-member engaged between an adjacent pair of uprights on one side of the playpen;

a second side cross-member pivotally connected between adjacent uprights at the opposite side of the playpen; and bending means in said second side cross-member and in each of said pair of end cross-member for permitted bending thereof with movement together of said uprights as said floor supports move toward their folded position.

8. A playpen according to claim 7 wherein said fabric enclosure includes side and end sleeves for engagement of said side and end cross-members, and corner sleeve for engagement of said uprights, said enclosure being permanently connected to said frame and a stuffened mattress which is removable from said enclosure before folding of said frame.

9. A playpen according to claim 8 wherein said first side cross-member is removable from between said uprights before folding of said frame.

10. A playpen according to claim 8 wherein said first side cross-member is pivotally connected to said adjacent pair of uprights on one side of the playpen, and elongation and bending means in said first side cross-member for permitting elongation of said first side cross-member during folding of said frame.

11. A playpen according to claim 10 including bending means in said first side cross-member for permitting bending of said first side cross-member with folding of said frame.

* * * * *